US007018485B2

(12) United States Patent
Tsujimoto et al.

(10) Patent No.: US 7,018,485 B2
(45) Date of Patent: Mar. 28, 2006

(54) APPARATUS FOR SUBJECTING RARE EARTH ALLOY TO HYDROGENATION PROCESS AND METHOD FOR PRODUCING RARE EARTH SINTERED MAGNET USING THE APPARATUS

(75) Inventors: Akihito Tsujimoto, Ibaraki (JP); Katsumi Okayama, Kusatsu (JP); Shinji Kidowaki, Osaka (JP); Tadayoshi Muneto, Wakayama (JP)

(73) Assignee: Neomax Co., Ltd., Osaka (JP)

( * ) Notice: Subject to any disclaimer, the term of this patent is extended or adjusted under 35 U.S.C. 154(b) by 331 days.

(21) Appl. No.: 10/381,006

(22) PCT Filed: Jun. 25, 2002

(86) PCT No.: PCT/JP02/06369

§ 371 (c)(1),
(2), (4) Date: Mar. 20, 2003

(87) PCT Pub. No.: WO03/002287

PCT Pub. Date: Jan. 9, 2003

(65) Prior Publication Data

US 2004/0000356 A1 Jan. 1, 2004

(30) Foreign Application Priority Data

Jun. 29, 2001 (JP) ..... 2001-198202

(51) Int. Cl.
*H01F 1/057* (2006.01)

(52) U.S. Cl. ..... 148/101; 148/102; 148/122; 241/1; 241/23; 241/30; 241/47; 266/252; 432/9; 432/14; 432/58; 432/64; 432/120; 432/198; 432/212; 432/228; 419/12; 419/33; 419/38

(58) Field of Classification Search ..... 148/101, 148/102, 122; 266/252; 241/1, 30, 23, 47; 432/9, 14, 58, 64, 120, 198, 212, 228; 419/12, 419/33, 38
See application file for complete search history.

(56) References Cited

U.S. PATENT DOCUMENTS 4,760,966 A * 8/1988 Finnegan et al. ..... 241/1

(Continued)

FOREIGN PATENT DOCUMENTS

JP 6-346113 12/1994

(Continued)

OTHER PUBLICATIONS

EP 992309 A2(Sumitomo Special Metals Co., LTD) Apr. 12, 2000 & JP 2000-178612 A.
JP 2000-303107 A (Sumitomo Special Metals Co., LTD.) Oct. 31, 2000 & DE 10007449 A.

*Primary Examiner*—John P. Sheehan
(74) *Attorney, Agent, or Firm*—Keating & Bennett, LLP

(57) ABSTRACT

An apparatus for subjecting a rare earth alloy block to a hydrogenation process includes a casing, gas inlet and outlet ports, a member arranged to produce a gaseous flow, and a windbreak plate. The casing defines an inner space for receiving a container. The container includes an upper opening and stores the rare earth alloy block therein. A hydrogen gas and an inert gas are introduced into the inner space through the gas inlet port, and are exhausted from the inner space through the gas outlet port. The gaseous flow is produced by a fan, for example, in the inner space. The windbreak plate is disposed upstream with respect to the gaseous flow that has been produced inside the inner space. Also, the windbreak plate reduces a flow rate of the gaseous flow that has been produced near the upper opening of the container.

9 Claims, 8 Drawing Sheets

U.S. PATENT DOCUMENTS

| | | | | | |
|---|---|---|---|---|---|
| 4,770,723 | A | | 9/1988 | Sagawa et al. | |
| 4,792,368 | A | | 12/1988 | Sagawa et al. | |
| 4,853,045 | A | * | 8/1989 | Rozendaal | 148/103 |
| 5,143,560 | A | * | 9/1992 | Doser | 148/101 |
| 5,338,371 | A | * | 8/1994 | Nakayama et al. | 148/101 |
| 5,383,978 | A | | 1/1995 | Yamamoto et al. | |
| 5,993,732 | A | * | 11/1999 | Nakayama et al. | 419/31 |
| 6,113,846 | A | * | 9/2000 | Honkura et al. | 266/257 |
| 6,247,660 | B1 | | 6/2001 | Imai et al. | |
| 6,403,024 | B1 | | 6/2002 | Oota et al. | |
| 6,709,533 | B1 | * | 3/2004 | Honkura et al. | 148/105 |

FOREIGN PATENT DOCUMENTS

| | | |
|---|---|---|
| JP | 7-331304 | 12/1995 |
| JP | 9-031609 | 2/1997 |
| JP | 2000-303107 | 10/2000 |

* cited by examiner

APPARATUS FOR SUBJECTING RARE EARTH ALLOY TO HYDROGENATION PROCESS AND METHOD FOR PRODUCING RARE EARTH SINTERED MAGNET USING THE APPARATUS

TECHNICAL FIELD

The present invention relates to an apparatus that can be used effectively to subject a block of a rare earth alloy to a hydrogenation process such as a hydrogen pulverization process, and also relates to a method for producing a rare earth sintered magnet using the apparatus.

BACKGROUND ART

A rare earth sintered magnet is produced by pulverizing a magnetic alloy into an alloy powder, compacting the alloy powder to obtain a green compact, sintering the green compact and then subjecting the sintered body to an aging treatment. Rare earth sintered magnets currently used extensively in various fields of applications include a samarium-cobalt (Sm—Co) type magnet and a neodymium-iron-boron type magnet (which will be herein referred to as an "R—T—(M)—B type magnet" but is also called an "R—Fe—B type magnet" normally). Among other things, the R—T—(M)—B type magnet is used more and more often in various types of electronic appliances. This is because the R—T—(M)—B type magnet exhibits a maximum energy product $(BH)_{max}$ that is higher than any of various other types of magnets, and yet is relatively inexpensive.

In the general formula R—T—(M)—B of the neodymium-iron-boron type magnet, R is at least one of the rare earth elements including yttrium (Y) and is typically neodymium (Nd), T is either iron (Fe) alone or a mixture of Fe and a transition metal element, M is at least one additive, and B is either boron alone or a mixture of boron and carbon. More particularly, T is preferably either Fe alone or a mixture of Fe and at least one of Ni and Co. In the latter case, Fe preferably accounts for about 50 at % or more of T. The additive M is preferably at least one element selected from the group consisting of Al, Ti, Cu, V, Cr, Ni, Ga, Zr, Nb, Mn, Mo, In, Sn, Hf, Ta and W, and preferably accounts for about 1 mass % or less of the entire magnet. Also, where B is a mixture of boron and carbon, boron preferably accounts for about 50 at % or more of the mixture. R—T—(M)—B type sintered magnets, to which various preferred embodiments of the present invention are applicable, are described in U.S. Pat. Nos. 4,770,723 and 4,792,368, for example, which are hereby incorporated by reference.

In the prior art, an R—T—(M)—B type alloy has been prepared as a material for such a magnet by an ingot casting process. In an ingot casting process, normally, rare earth metal, electrolytic iron and ferroboron alloy as respective starting materials are melted by an induction heating process, and then the melt obtained in this manner is cooled relatively slowly in a casting mold, thereby preparing an alloy ingot.

Recently, a rapid cooling process such as a strip casting process or a centrifugal casting process has attracted much attention in the art. In a rapid cooling process, a molten alloy is brought into contact with, and relatively rapidly cooled and solidified by, the outer or inner surface of a single chill roller or a twin chill roller, a rotating chill disk or a rotating cylindrical casting mold, thereby making a rapidly solidified alloy, which is thinner than an alloy ingot, from the molten alloy. The rapidly solidified alloy prepared in this manner will be herein referred to as an "alloy flake". The alloy flake produced by such a rapid cooling process normally has a thickness of about 0.03 mm to about 10 mm. According to the rapid cooling process, the molten alloy starts to be solidified from a surface thereof that has been in contact with the surface of the chill roller. That surface of the molten alloy will be herein referred to as a "roller contact surface". Thus, in the rapid cooling process, columnar crystals grow in the thickness direction from the roller contact surface. As a result, the rapidly solidified alloy, made by a strip casting process or any other rapid cooling process, has a structure including an $R_2Fe_{14}B$ crystalline phase and an R-rich phase. The $R_2Fe_{14}B$ crystalline phase usually has a minor-axis size of about 0.1 μm to about 100 μm and a major-axis size of about 5 μm to about 500 μm. On the other hand, the R-rich phase, which is a non-magnetic phase including a rare earth element R at a relatively high concentration, is dispersed in the grain boundary between the $R_2Fe_{14}B$ crystalline phases.

Compared to an alloy made by the conventional ingot casting process or die casting process (such an alloy will be herein referred to as an "Ingot alloy"), the rapidly solidified alloy has been cooled and solidified in a shorter time (i.e., at a cooling rate of about $10^{2\circ}$ C./sec to about $10^{4\circ}$ C./sec). Accordingly, the rapidly solidified alloy has a finer structure and a smaller average crystal grain size. In addition, in the rapidly solidified alloy, the grain boundary thereof has a greater area and the R-rich phase is dispersed broadly and thinly in the grain boundary. Thus, the rapidly solidified alloy also excels in the dispersiveness of the R-rich phase. Because the rapidly solidified alloy has the above-described advantageous features, a magnet with excellent magnetic properties can be made from the rapidly solidified alloy.

An alternative alloy preparation method called "Ca reduction process (or reduction-diffusion process)" is also known in the art. This process includes the steps of adding metal calcium (Ca) and calcium chloride (CaCl) to either the mixture of at least one rare earth oxide, iron powder, pure boron powder and at least one of ferroboron powder and boron oxide at a predetermined ratio or a mixture including an alloy powder or mixed oxide of these constituent elements at a predetermined ratio, subjecting the resultant mixture to a reduction-diffusion treatment within an inert atmosphere, diluting the reactant obtained to make a slurry, and then treating the slurry with water. In this manner, a solid of an R—T—(M)—B type alloy can be obtained.

It should be noted that any small block of a solid alloy will be herein referred to as an "alloy block". The "alloy block" may be any of various forms of solid alloys that include not only solidified alloys obtained by cooling a melt of a material alloy either slowly or rapidly (e.g., an alloy ingot prepared by the conventional ingot casting process or an alloy flake prepared by a quenching process such as a strip casting process) but also a solid alloy obtained by the Ca reduction process.

An alloy powder to be compacted is obtained by performing the steps including coarsely pulverizing an alloy block in any of these forms by a hydrogen pulverization process, for example, and/or any of various mechanical milling processes (e.g., using a feather mill, power mill or disk mill), and finely pulverizing the resultant coarse powder (with a mean particle size of about 10 μm to about 1000 μm) by a dry milling process using a jet mill, for example. The alloy powder to be compacted preferably has a mean particle size of about 1.5 μm to about 7 μm to achieve sufficient magnetic properties. It should be noted that the "mean particle sizes" of a powder herein refers to a mass median diameter (MMD)

unless stated otherwise. The coarse powder may also be finely pulverized by using a ball mill or attritor.

The hydrogen pulverization process is a pulverization technique that utilizes the phenomenon that very small cracks are created in the rare earth alloy material (typically an alloy block) due to the volume expansion of the alloy material being exposed to a hydrogen gas atmosphere. This expansion is caused by the hydrogenation of the rare earth element that is included in the alloy material. Compared to the mechanical milling process, the hydrogen pulverization process increases the productivity and reduces the oxidation of the rare earth element in the subsequent processing and manufacturing steps. When a rapidly solidified alloy is used as the material alloy block, the alloy block can be coarsely pulverized by the hydrogen pulverization process to a size of about 1 mm or less (typically to a mean particle size of about 10 μm to about 1000 μm). On the other hand, where the material alloy block is an alloy ingot or a solid alloy that has been prepared by the reduction-diffusion process, the coarse powder obtained will have a mean particle size of about 1 cm.

In the prior art, the hydrogen pulverization of an R—T—(M)—B type alloy is normally performed by filling a container, made of a stainless steel such as SUS304, with rare earth material alloy blocks and then subjecting the alloy blocks to hydrogen absorption and hydrogen desorption processes inside a hydrogen furnace.

Specifically, first, the alloy blocks, stored in the container, are loaded into the hydrogen furnace, where a reduced-pressure atmosphere is created. Next, a hydrogen gas is supplied into the hydrogen furnace, thereby making the alloy blocks occlude (or absorb) hydrogen. In this hydrogen occlusion (or absorption) process, the rare earth element included in the alloy blocks is hydrogenated. The hydrogenated portions of the alloy blocks expand their volumes, thereby creating cracks there. Subsequently, after a predetermined amount of time has passed, the hydrogen gas is exhausted from the hydrogen furnace to create a reduced-pressure atmosphere inside the furnace. At the same time, the furnace is also heated to make the hydrogenated portions of the alloy blocks desorb hydrogen. Thereafter, an inert gas is introduced into the furnace, thereby cooling the resultant coarse powder. In this cooling process, to cool the coarse powder with the inert gas more efficiently, a gaseous flow may be produced inside the hydrogen furnace by a fan provided inside the hydrogen furnace. Also, to increase the efficiency of this cooling process, a container (hydrogen pulverization case) as disclosed by the applicant of the present application in U.S. Pat. No. 6,247,660 B1, which is hereby incorporated by reference, is preferably used.

In the conventional hydrogen pulverization process, however, the hydrogen furnace cannot always maintain a completely airtight condition inside it. Thus, particularly while the hydrogen furnace has a reduced pressure inside, oxygen in the air should flow into the hydrogen furnace easily. But if oxygen is present inside the hydrogen furnace, then the rare earth element is oxidized, thus deteriorating the magnetic properties of sintered magnets to be obtained. For that reason, to minimize this unwanted oxidation, the gases should be introduced into, and exhausted from, the hydrogen furnace as quickly as possible. Also, to increase the productivity, the coarse powder needs to be cooled by the inert gaseous flow in the shortest possible time.

However, in the conventional hydrogen pulverization process, if the gases are introduced or exhausted in too short a time or if the inert gas is supplied at an excessively high flow rate into the hydrogen furnace for the purpose(s) of minimizing the disadvantageous oxidation and/or increasing the cooling rate (or productivity), then the coarse powder, obtained by the hydrogen pulverization process, might be blown off and scattered inside the hydrogen furnace. The scattered powder is mostly composed of relatively small particles, which include the rare earth element at a rather high percentage. Accordingly, if these small particles are scattered, then the overall composition of the coarse powder inside the container is different from the intended or desired composition. As a result, the desired magnetic properties may not be achieved. Also, those powder particles, which have been blown off, scattered and left at various locations inside the hydrogen furnace, may be oxidized when the hydrogen furnace is opened and exposed to the air. In that case, those oxidized alloy powder particles may be mixed with a coarse powder of the next batch during the next hydrogen pulverization process. Then, a defective coarse powder like this may result in a partially incompletely sintered body (i.e., decrease in sintered density). That is to say, the scattering of those small powder particles in the hydrogen pulverization process adversely decreases the yield of the material. Furthermore, if a portion of the hydrogen furnace is made of carbon, then the amount of carbon included in the rare earth alloy material (i.e., the coarse powder) may increase, thus possibly deteriorating the magnetic properties of the resultant sintered magnets.

Nevertheless, if the gases are introduced or exhausted, or the gaseous flow is produced, at rates that are too low to cause scattering of the small powder particles, then it takes too much time to cool the coarse powder obtained, thus decreasing the throughput. In addition, since a lot of air (or oxygen) should enter the furnace, the resultant magnetic properties may deteriorate, or in the worst-case scenario, the material might ignite.

Among other things, the powder particles, obtained by subjecting a block of a rapidly solidified alloy to such a hydrogen pulverization process, are relatively fine and easily oxidizable and many of them are small powder particles that are easily scattered inside the furnace. Also, those fine powder particles are normally packed densely enough inside the container, and cannot be ventilated so easily with the inert gaseous flow. That is to say, those fine powder particles cannot be cooled so efficiently. Accordingly, to cool the fine powder particles almost as efficiently as coarse powder particles, the inert gas should be supplied at a relatively high flow rate because of this reason also. Thus, the above-described problems caused by the unintentional scattering of powder particles are particularly significant in a hydrogen pulverization process of an alloy block obtained by a rapid cooling process.

These problems arise not only in the hydrogen pulverization process of a rare earth alloy block but also in any other hydrogenation process (e.g., HDDR process carried out to prepare a powder for an anisotropic bonded magnet).

DISCLOSURE OF INVENTION

In order to overcome the problems described above, preferred embodiments of the present invention provide an apparatus for subjecting a rare earth alloy to a hydrogenation process by which unwanted oxidation of the rare earth element is minimized sufficiently and productivity is increased significantly, and also provide a method for producing a rare earth sintered magnet using such an apparatus.

A preferred embodiment of the present invention provides an apparatus for subjecting a rare earth alloy block to a hydrogenation process. The apparatus preferably includes a casing, a gas inlet port, a gas outlet port, a member arranged to produce a gaseous flow, and a windbreak plate. The casing preferably defines an inner space for receiving a container. The container preferably includes an upper opening and preferably stores the rare earth alloy block therein. A hydrogen gas and an inert gas are preferably introduced into the inner space through the gas inlet port and preferably exhausted from the inner space through the gas outlet port. A gaseous flow is preferably produced inside the inner space. The windbreak plate is preferably disposed upstream with respect to the gaseous flow that has been produced inside the inner space and preferably reduces a flow rate of the gaseous flow that has been produced near the upper opening of the container.

In one preferred embodiment of the present invention, the container preferably further includes a bottom surface and side surfaces, and the windbreak plate preferably includes a shielding portion and at least one opening. The shielding portion is preferably located at a vertical level corresponding to that of the upper opening of the container. The at least one opening is preferably opposed to at least one of the side surfaces of the container.

In this particular preferred embodiment, the container preferably includes at least one hollow pipe. The hollow pipe preferably connects together two of the side surfaces of the container and preferably has an inner surface that is substantially continuous with the two side surfaces. The two side surfaces are preferably opposed to the windbreak plate.

More specifically, the at least one opening of the windbreak plate is preferably disposed so as to face the at least one hollow pipe.

In still another preferred embodiment, the apparatus may further include a second windbreak plate. The second windbreak plate preferably includes a shielding portion that covers the upper opening of the container.

In that case, the second windbreak plate preferably has at least one opening.

Another preferred embodiment of the present invention provides an apparatus for subjecting a rare earth alloy block to a hydrogenation process. The apparatus preferably includes a casing, a member arranged to supply a gas and a windbreak plate. The casing preferably defines an inner space for receiving a container. The container preferably includes an upper opening and preferably stores the rare earth alloy block therein. An atmosphere inside the inner space is preferably controllable to a reduced-pressure state. A gas is preferably supplied into the inner space. The windbreak plate preferably reduces a flow rate of a gaseous flow that has been produced near the upper opening of the container.

Still another preferred embodiment of the present invention provides a method for producing a rare earth sintered magnet. The method preferably includes the steps of preparing a container, which includes an upper opening and which stores a rare earth alloy block therein, pulverizing the rare earth alloy block into a coarse powder by performing a hydrogen pulverization process using the apparatus according to any of the preferred embodiments of the present invention described above, making a fine powder from the coarse powder, and compacting the fine powder to obtain a green compact and sintering the green compact.

In one preferred embodiment of the present invention, the rare earth alloy block is preferably a rare earth alloy flake that has been obtained by subjecting a melt of a rare earth alloy to a quenching process.

Other features, elements, characteristics, steps and advantages of the present invention will become more apparent from the following detailed description of preferred embodiments with reference to the attached drawings.

BEST MODE FOR CARRYING OUT THE INVENTION

Hereinafter, preferred embodiments of the present invention will be described with reference to the accompanying drawings. In the following specific preferred embodiments, the present invention will be described as being applied to a hydrogen pulverization process of a rare earth alloy block. However, the present invention is in no way limited to the illustrative embodiments to be described below.

Figure 1:
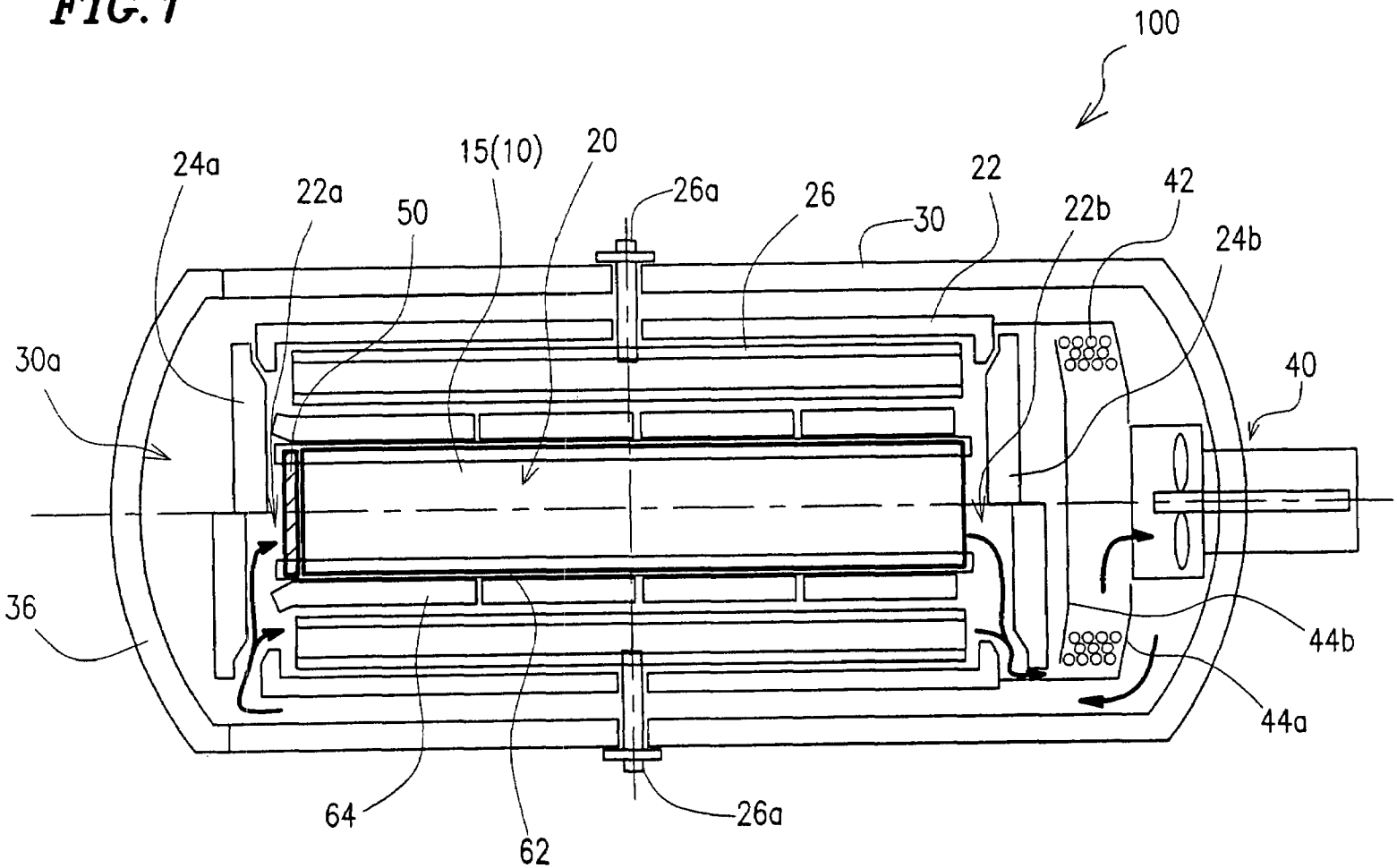
FIG. 1 is a top view schematically illustrating a structure of a hydrogen pulverizer 100 according to a preferred embodiment of the present invention.
Figure 2:
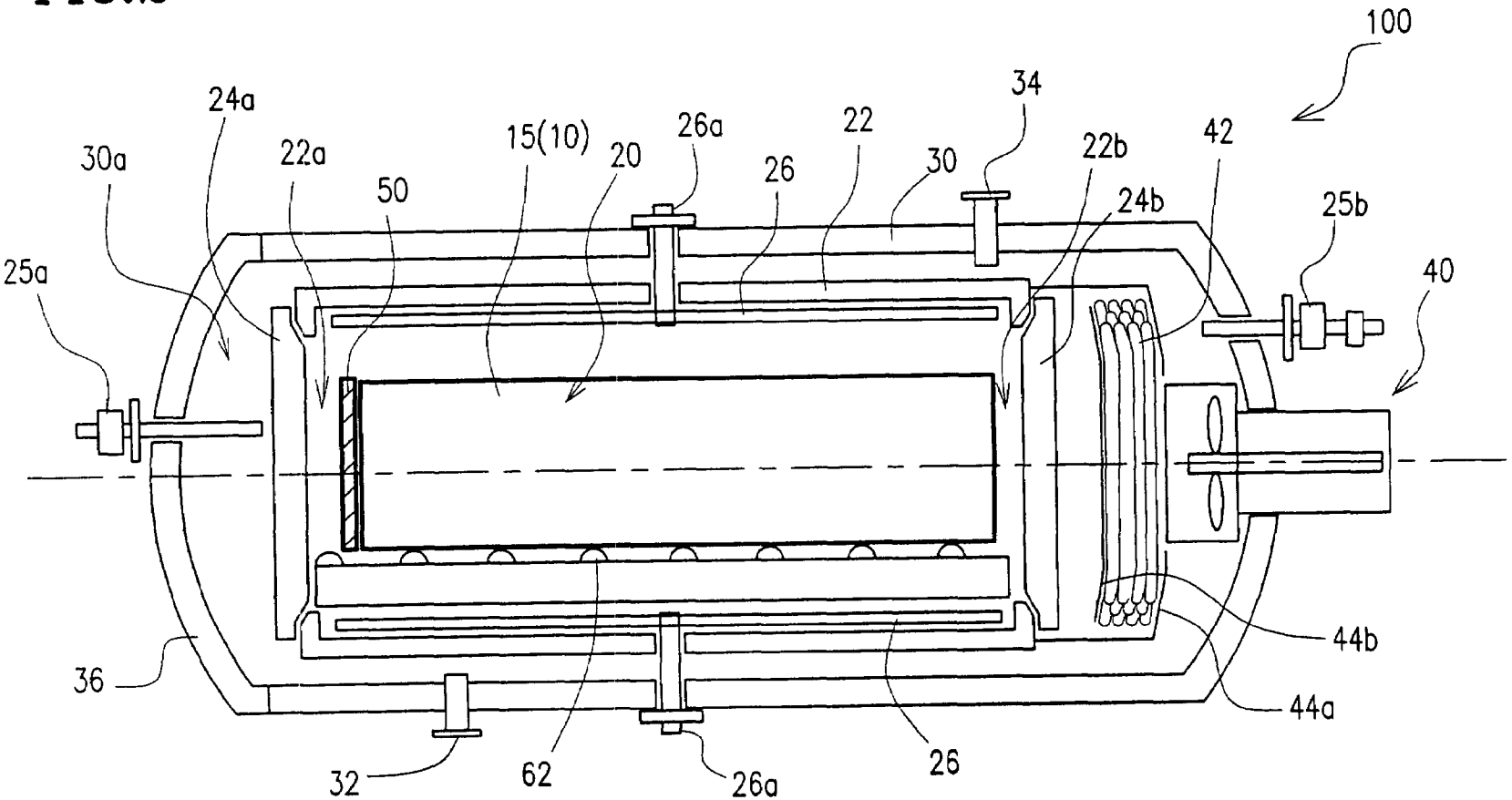
FIG. 2 is a side view schematically illustrating the structure of the hydrogen pulverizer 100 shown in FIG. 1.
Figure 3:
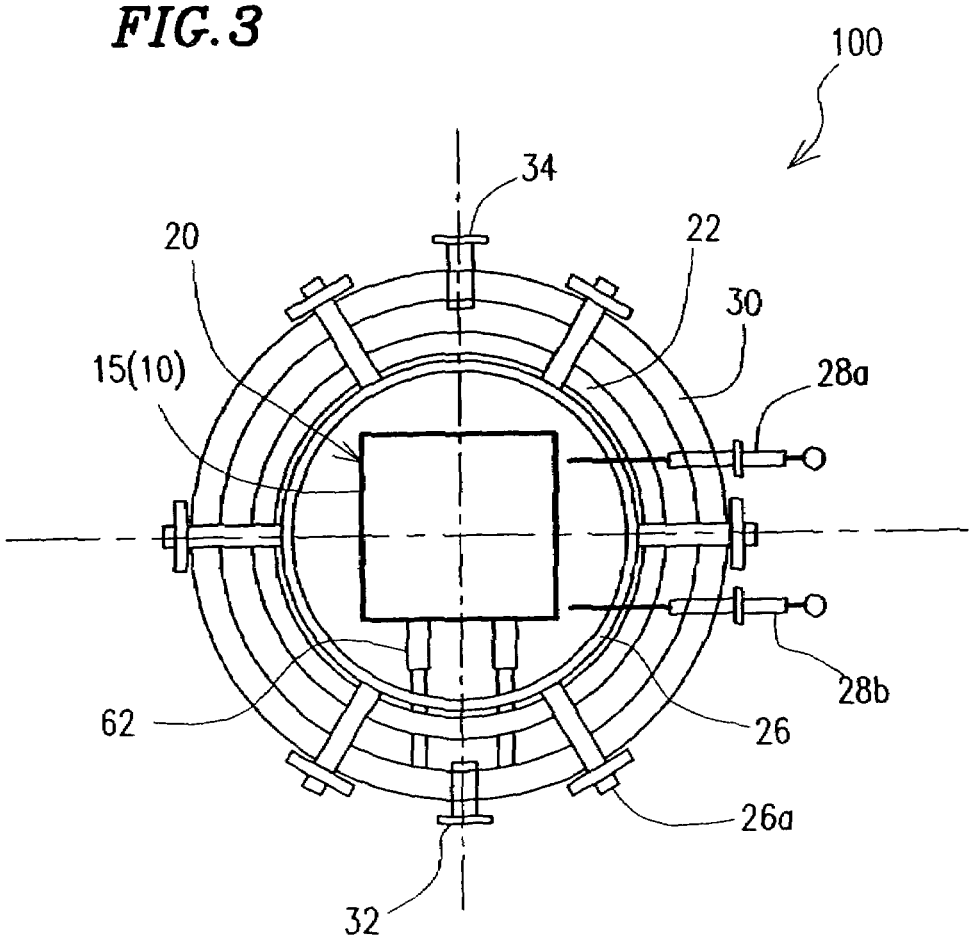
FIG. 3 is a front view schematically illustrating the structure of the hydrogen pulverizer 100 shown in FIG. 1.

FIGS. 1, 2 and 3 respectively illustrate a top view, a side view and a front view of a hydrogen pulverizer (which will also be herein referred to as a "hydrogen furnaces") 100 according to a preferred embodiment of the present invention.

The hydrogen pulverizer 100 includes a casing 30, gas inlet and outlet ports 32 and 34, a fan 40 and a windbreak plate 50. The casing 30 defines an inner space 20 in which multiple containers 10 (see FIG. 7, for example), including rare earth alloy blocks, are received. A hydrogen gas and an inert gas are introduced through the gas inlet port 32 into the inner space 20 and exhausted from the inner space 20 through the gas outlet port 34. The fan 40 is used as a member arranged to produce a gaseous flow inside the inner space 20. The windbreak plate 50 is disposed upstream with respect to the gaseous flow that has been produced inside the inner space 20. The windbreak plate 50 is provided to reduce a flow rate of the gaseous flow that has been produced around the upper opening 10*a* of each container 10. As used herein, the "gaseous flow" refers to the flow of an atmospheric gas that is present inside the inner space 20. The gaseous flow means the dynamic flow of any gas, no matter what type the gas is or what composition the gas has. It should be noted that the "strength" of the gaseous flow is herein represented by the flow rate or the pressure of the gaseous flow.

As will be described in detail later with reference to FIG. 8, the windbreak plate 50 includes a shielding portion 50*b* at a vertical level corresponding to that of the upper opening 10*a* of one of the containers 10 that have been stored in the inner space 20. The windbreak plate 50 also includes at least one opening 50*a* that is opposed to a side surface 12 of the container 10. Thus, the windbreak plate 50 decreases the flow rate of the gaseous flow that has been produced around the upper opening 10*a* of the container 10 but increases that of the gaseous flow that has been produced around the side surface 12 of the container 10. Accordingly, it is possible to prevent the powder stored in the container 10 from being blown off by the gaseous flow that has been produced around the upper opening 10*a* thereof.

The structure of the hydrogen pulverizer 100 will be described in further detail with reference to FIGS. 1, 2 and 3.

As shown in FIGS. 1 and 2, the hydrogen pulverizer 100 preferably includes the casing 30 and a lid 36, which is opened and closed to load and unload the containers 10 into/from the inner space 20 of the casing 30 through an opening 30*a* of the casing 30. The inner space 20 to receive the containers 10 may be defined around the center of the casing 30 as a region in which the temperature, the pressure of the atmospheric gas and the flow rate of the gaseous flow are controlled to respective predetermined ranges. The casing 30 and the lid 36 are preferably made of a stainless steel such as SUS304L, SUS316 or SUS316L to decrease the brittleness to hydrogen. Also, the casing 30 preferably has an inner volume of about 3.0 $m^3$ to about 5.2 $m^3$.

Inside the casing 30, a tube 22 and front and rear caps 24*a* and 24*b* are provided. The tube 22 may be made of a heat insulator (e.g., carbon) and has front and rear openings 22*a* and 22*b*. The front opening 22*a* is provided behind the front cap 24*a*, while the rear opening 22*b* is provided behind the rear cap 24*b*. The front and rear caps 24*a* and 24*b* are preferably made of the same heat insulator as the tube 22, and are opened and closed by opening/closing cylinders 25*a* and 25*b*, respectively. In FIG. 1, the front and rear caps 24*a* and 24*b* are illustrated as being closed over the one-dot chain (centerline) and opened under the one-dot chain.

When the tube 22 and the front and rear caps 24*a* and 24*b* are closed, the tube 22 and the front and rear openings 22*a* and 22*b* form a hermetically sealed space, in which a heater 26 is provided to heat the inner space 20. As shown in FIG. 3, this heater 26 is disposed around the entire inner circumference of the tube 22 to heat the inner space 20 almost uniformly. The heater 26 may be made of carbon graphite, which has sufficient resistance to a hydrogen gas. As also shown in FIG. 3, upper and lower thermocouples 28*a* and 28*b* are provided to monitor the temperature of the inner space 20. By adjusting the quantity of electrical power supplied from electrodes 26*a* to the heater 26 in response to the outputs of the thermocouples 28*a* and 28*b*, the temperature inside the inner space 20 is controllable. It should be noted that the electrodes 26*a* also function as members for supporting the heater 26 thereon.

Figure 4:
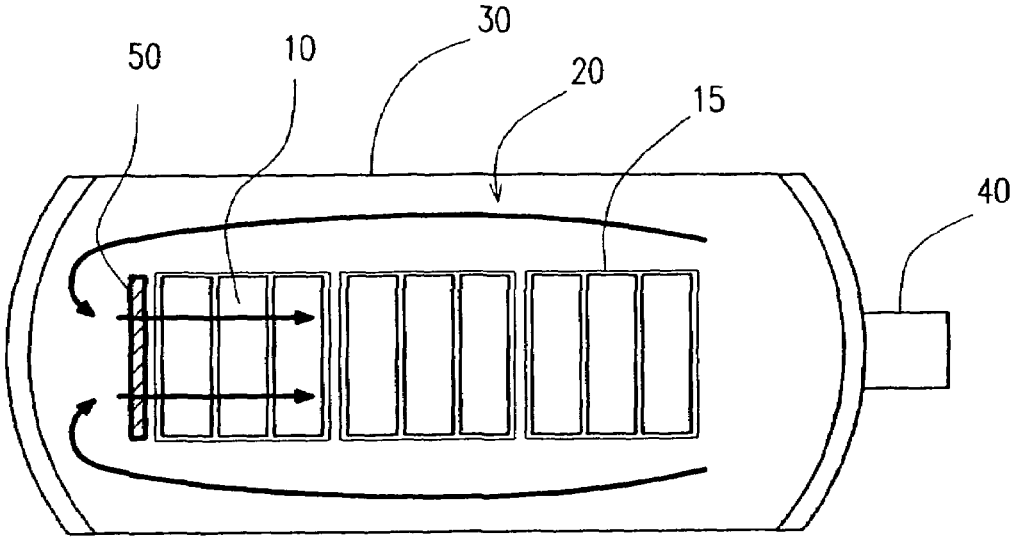
FIG. 4 is a top view schematically illustrating the arrangement of containers 10 in the hydrogen pulverizer 100.
Figure 5:
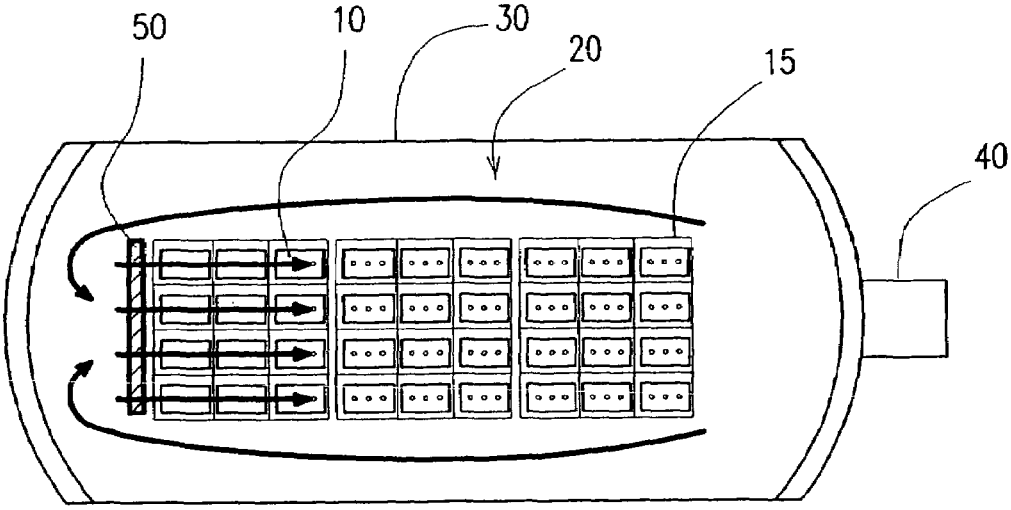
FIG. 5 is a side view schematically illustrating the arrangement of the containers 10 in the hydrogen pulverizer 100.
Figure 6:
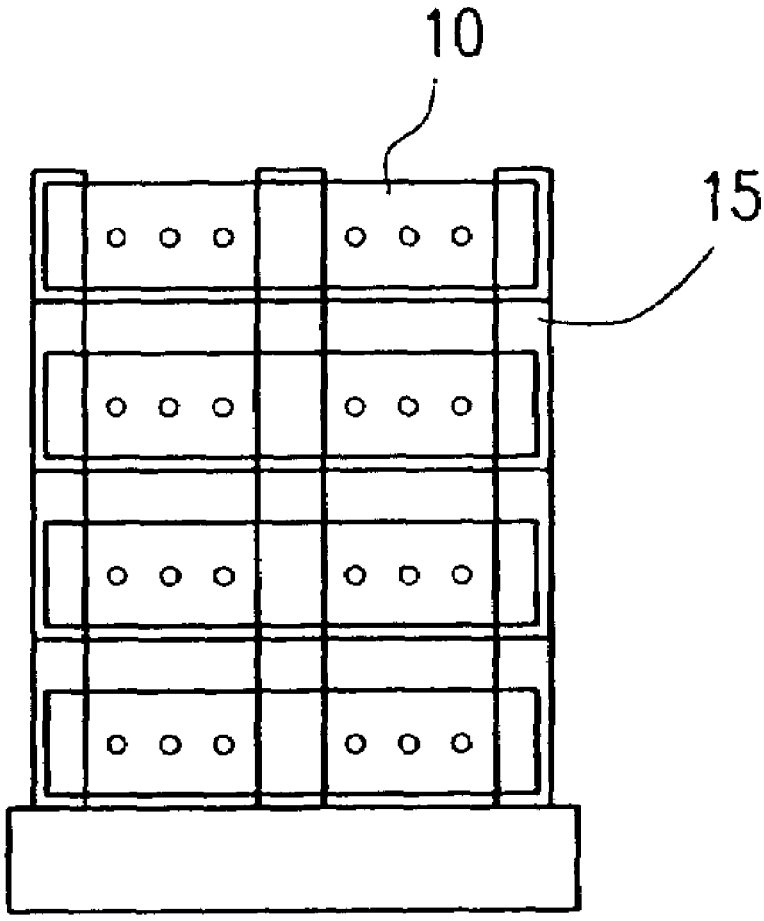
FIG. 6 is a front view schematically illustrating the arrangement of the containers 10 in the hydrogen pulverizer 100.

The containers 10, including the rare earth alloy blocks, are mounted onto a rack 15 (see FIG. 4, for example), which is then loaded into the inner space 20. The hydrogen pulverizer 100 includes bottom guide rollers 62 for supporting the bottom of the rack 15 and rolling the rack 15 thereon as shown in FIG. 2, and also includes side guides 64 as shown in FIG. 1. By using these rollers 62 and guides 64, the rack 15 can be guided to a predetermined position inside the inner space 20. That is to say, the "inner space" 20 is the space that is surrounded with the heater 26 and defined to store the rack 15 therein as described above. Optionally, multiple racks 15 may be loaded into this hydrogen pulverizer 100 and subjected to the hydrogen pulverization process simultaneously. The number of the containers 10 to be mounted on each rack 15 and the sizes of each rack 15 may be changed appropriately in view of the work efficiency to be achieved. In this preferred embodiment, four layers of three containers 10 are preferably mounted on each of the three racks 15 and then the three racks 15 are loaded into the inner space 20 one after another as shown in FIGS. 4, 5 and 6. That is to say, numerous rare earth alloy blocks, stored in the thirty-six containers 10 in total, are simultaneously subjected to the hydrogen pulverization process.

Through the gas inlet port 32 of the casing 30, a hydrogen gas and an inert gas (e.g., Ar or He gas) are supplied into the casing 30. The gas inlet port 32 is connected to a cooler (not shown), which controls the temperatures of the gases supplied into the casing 30. The gases introduced are changed from one stage of the hydrogen pulverization process to another by operating valves (not shown), for example. On the other hand, the gas outlet port 34 is connected to an exhaust unit (not shown) such as a Roots pump or a hydraulic pump so that the gases are exhausted from the casing 30 through the gas outlet port 34. These gas introducing and exhausting members may be arranged as disclosed in Japanese Laid-Open Publication No. 2000-303107 (corresponding to U.S. Pat. No. 6,403,024, which is hereby incorporated by reference), for example. The hydrogen pulverizer 100 according to this preferred embodiment is preferably a batch processing type. However, the effects of the present invention are also achieved by providing the windbreak plate for an apparatus of a continuous processing type (e.g., continuous vacuum furnace FS series produced by ULVAC Corporation).

As used herein, the "inert gas" may include reactive gases (e.g., oxygen gas and/or nitrogen gas) at very small percentages. However, the percentages of the oxygen gas and the nitrogen gas included in the "inert gas" are preferably no greater than about 5 mol % and no greater than about 20 mol %, respectively, and are more preferably about 1 mol % or less and about 4 mol % or less, respectively.

The type and pressure of the atmospheric gas that is created inside the casing 30 are controllable according to a predefined program by adjusting the flow rates of the gases to be supplied into, and exhausted from, the casing 30. Also, the temperature of the atmospheric gas created inside the hydrogen pulverizer 100 is controllable by operating the heater 26 in accordance with a preset temperature profile while monitoring the output of a temperature sensor provided inside the furnace. The flow rate of the atmospheric gas is controlled by the fan 40 and the temperature of the atmospheric gas may be decreased by a cooler (cooling pipes) 42 disposed between the fan 40 and the inner space 20. Furthermore, the temperature of the inert gas may also be controlled by the cooler (not shown) connected to the gas inlet port 32. Such temperature controls may be performed by a controller (not shown).

By turning the fan 40, a gaseous flow is produced as indicated by the arrows under the centerline in FIG. 1. This is because the gas that has been introduced through the gas inlet port 32 (see FIG. 2) into the gap between the casing 30 and the tube 22 has its channel limited by the tube 22, front and rear caps 24*a* and 24*b* and channel limiting walls 44*a* and 44*b*.

The lid 36 of the hydrogen pulverizer 100 is closed at least during the hydrogen pulverization process, thereby keeping the space inside the casing 30 completely sealed hermetically during the hydrogen pulverization process. While the containers 10 (i.e., the racks 15) are being loaded or unloaded into/from this hydrogen pulverizer 100, the lid 36 of the hydrogen pulverizer 100 is lifted up by a driving mechanism (not shown), thereby exposing the opening 30*a* of the hydrogen pulverizer 100. FIG. 1 illustrates a state in which the lid 36 is closed. Since the casing 30 and the lid 36 have a mechanical strength high enough to resist both increased-pressure and reduced-pressure states inside the furnace, any of various types of hydrogenation processes can be carried out safely inside this hydrogen pulverizer 100.

In this preferred embodiment, a number of containers 10, each having approximate dimensions of 300 mm×150 mm×500 mm, for example, are mounted onto the racks 15, which are then loaded into the inner space 20 as shown in FIGS. 4, 5 and 6. FIGS. 4, 5 and 6 are respectively a top view, a side view and a front view schematically illustrating the arrangement of the containers 10 that have been stored inside the inner space 20. These containers 10 that have been mounted on the racks 15 are spaced apart from each other both horizontally and vertically so as to allow the gas to flow easily between adjacent ones of the containers 10.

The containers 10 and the racks 15 are preferably made of a stainless steel such as SUS304L, which exhibits desired low brittleness to hydrogen. The containers 10 are typically boxes and are preferably relatively shallow (e.g., having a depth of about 10 cm or less) to hydrogenate the rare earth alloy blocks uniformly. Also, even if the containers 10 are relatively deep boxes, the alloy blocks are preferably packed into the containers 10 so as to have a depth of about 10 cm as measured from the surface thereof. This is done to expose the widest possible surface area (preferably the entire area) of the alloy blocks to the hydrogen atmosphere uniformly. The reason is that if a shallow container 10 were filled with a lot of alloy blocks, then it might be difficult to subject those alloy blocks to the hydrogen pulverization process uniformly. Each of the racks 15 for supporting the containers 10 thereon preferably has a sufficient mechanical strength and preferably exposes the respective sides of the containers 10 as much as possible to maximize the area of the bottom or side surfaces of the containers 10 in which heat is directly exchanged with the atmospheric gas.

Figure 7A:
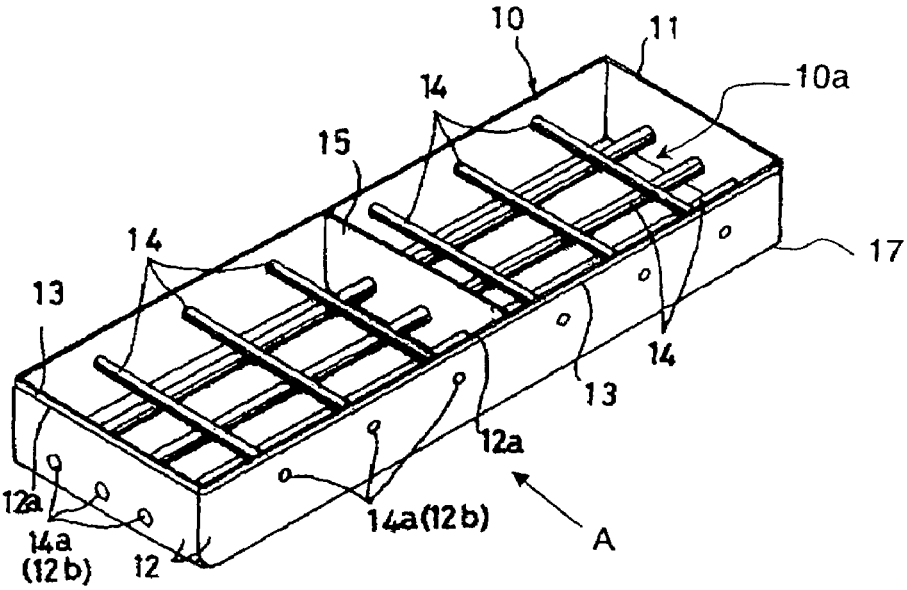
FIG. 7A is a perspective view illustrating one of the containers 10 for use to store rare earth alloy blocks therein in various preferred embodiments of the present invention.

The container 10 for storing the rare earth alloy blocks therein is preferably such as that shown in FIG. 7A and disclosed in U.S. Pat. No. 6,247,660 B1, which is hereby incorporated by reference.

The body 11 of the container 10 preferably is a substantially rectangular parallelepiped box (with approximate dimensions of 500 mm×185 mm×85 mm, for example) having an elongated upper opening 10*a* to increase the mass-productivity. As shown in FIG. 7A, a partition 15 is provided at the approximate center of the body 11. To increase the heat transfer and dissipation effects, three hollow pipes 14, having an outer diameter of about 12 mm and an inner diameter of about 9 mm, are attached to the shorter side surfaces 12 of the container body 11 at around the intermediate vertical level thereof. Specifically, as shown in FIG. 7A, these three pipes 14 extend through the partition 15 along the length of the container body 11, and their hollow ends 14*a* are fitted with respective openings 12*b* of the shorter side surfaces 12 of the container 10. In addition, six more hollow pipes 14, having an outer diameter of about 10 mm and an inner diameter of about 8 mm, are attached to the longer side surfaces 12 of the container body 11 so as to extend over the three hollow pipes 14 between the shorter side surfaces 12. Specifically, as shown in FIG. 7A, these six pipes 14 have their hollow ends 14*a* fitted with respective openings 12*b* of the longer side surfaces 12 of the container 10. That is to say, in the preferred embodiment illustrated in FIG. 7A, each of these nine hollow pipes 14 has an inner surface 14*a*, which is substantially continuous with its associated side surface 12. It should be noted that the hollow ends and the inner surfaces of the hollow pipes are herein identified by the same reference numeral of 14*a*. Also, in the preferred embodiment illustrated in FIG. 7A, the hollow ends 14*a* of the hollow pipes 14 are substantially flush with the openings 12*b* of the side surfaces 12 of the container 10. Alternatively, the ends 14*a* of the hollow pipes 14 may protrude from the side surfaces 12 of the container 10. In any case, the air should be able to enter the hollow pipes 14 through the hollow ends 14*a*. It should be noted that the side surfaces 12 of the container 10, extending substantially vertically to the direction in which the gaseous flow produced in the inner space 20 flows, (i.e., the longer side surfaces 12 in the preferred embodiment illustrated in FIG. 7), contribute to the heat transfer and dissipation significantly. Accordingly, the hollow pipes 14 should be provided at least between these longer side surfaces 12 but do not have to be present between the other, shorter side surfaces 12.

Also, to increase the mechanical strength of the container 10, the upper edge of the side surfaces 12 of the container body 11 is preferably provided with a reinforcing tab 13 preferably made of copper, for example. Furthermore, the bottom of the container body 11 is preferably surrounded with a reinforcing lower frame 17. The container body 11, hollow pipes 14, partition 15 and reinforcing lower frame 17 are also preferably made of a stainless steel such as SUS304L, which exhibits desired low brittleness to hydrogen. To achieve an even higher thermal conductivity, these members are preferably made of a material having a thermal conductivity of about 2.35 W/cm·deg or more (e.g., copper or aluminum alloy).

Such containers 10 are mounted onto the racks 15 as shown in FIGS. 4, 5 and 6. As can be seen from these drawings, these containers 10 are arranged so that their longer side surfaces 12 are opposed to the front side, i.e., so that the longer side surfaces 12 extend substantially vertically to the direction in which the gaseous flow produced in the inner space 20 flows as indicated by the arrows in FIG. 5.

The windbreak plate 50 is disposed in front of the rack 15 that is closest to the opening 30*a*. The gas, which has passed through the windbreak plate 50, flows around the containers 10 that have been mounted on the racks 15.

Hereinafter, the positional relationship between the windbreak plate 50 and the containers 10 that have been stored in the inner space 20 will be described with reference to FIG. 8.

Figure 8:
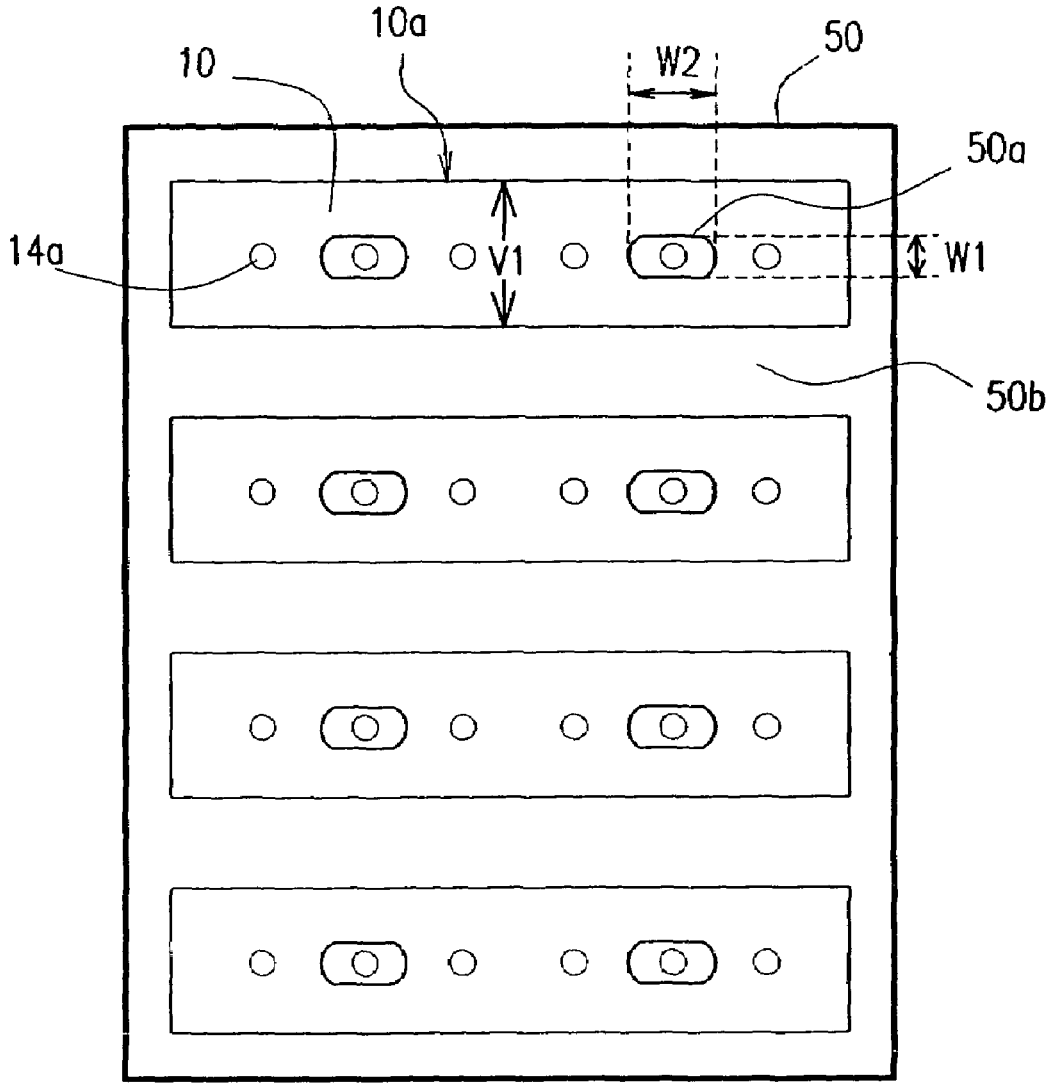
FIG. 8 is a plan view schematically illustrating a structure of a windbreak plate 50 provided for the hydrogen pulverizer 100.

As shown in FIG. 8, the windbreak plate 50 includes openings 50*a* and shielding portions 50*b* (i.e., the remaining portions of the windbreak plate 50 other than the openings 50*a*). To produce the gaseous flow around the containers 10 that have been stacked in multiple layers (i.e., four layers in this preferred embodiment) on the racks 15, the openings 50*a* are provided at respective vertical levels corresponding to those layers. Also, as shown in FIG. 8, multiple openings 50*a* are preferably provided for each level so that the side surfaces 12 of the containers 10 in each layer are exposed to the gaseous flow as uniformly as possible.

Also, to decrease the flow rate of the gaseous flow that has been produced around the upper opening 10*a* of each container 10, the windbreak plate 50 is preferably disposed so that its openings 50*a* do not face the upper openings 10*a* of the containers 10. More specifically, the windbreak plate 50 is disposed so that the upper end of each opening 50*a* is located at a vertical level that is substantially equal to or lower than that of the upper opening 10*a* of its associated container 10 and that the lower end of each opening 50*a* is located at a vertical level that is substantially equal to or higher than that of the bottom of its associated container 10.

Typically, the windbreak plate 50 is disposed such that each opening 50*a* thereof faces approximately the vertical center of the side surface 12 of its associated container 10. If the container 10 includes the hollow pipes 14 extending between its side surfaces 12 that are opposed to the windbreak plate 50, then the hollow end 14*a* of each of the hollow pipes 14 is preferably located between the upper and lower ends of its associated opening 50*a*. That is to say, as shown in FIG. 8, the hollow end 14*a* of each hollow pipe 14 of the container 10 is preferably located within the vertical width W1 defined by the upper and lower ends of its associated opening 50*a*. Also, when the hollow end 14*a* of each hollow pipe 14 is located at the intermediate vertical level of the side surface 12 of the container 10, this width W1 is preferably about one third or less of the vertical width V1 of the side surface 12, more preferably about one fourth or less of the vertical width V1. Normally, the difference in vertical level between the upper end of each opening 50*a* and the upper opening 10*a* of its associated container 10 is preferably approximately equal to or smaller than the vertical width W1 of the opening 50*a*. If this level difference is too small, then the gaseous flow produced around the opening 10*a* will have an excessively high flow rate. Then, the unwanted scattering of the alloy powder particles from the container 10 might not be sufficiently prevented.

On the other hand, the horizontal width W2 of each opening 50*a* does not have to be great enough to include all of its associated ones of the hollow ends 14*a*. That is to say, some of the hollow ends 14*a* may not face any of the openings 50*a*. Instead, the width W2 needs to be defined so that the gaseous flow can be supplied to its associated container 10 substantially uniformly and that a sufficient amount of gaseous flow can flow through its associated hollow pipes 14.

As described above, the hydrogen pulverizer 100 of this preferred embodiment includes the windbreak plate 50 having the shielding portions 50*b* that are located at vertical levels corresponding to those of the upper openings 10*a* of the containers 10 in which the rare earth alloy blocks are stored. Accordingly, when a gaseous flow is produced in the inner space 20, the gaseous flow will have a decreased flow rate around the upper openings 10*a* of the containers 10. Thus, it is possible to prevent, or at least minimize, the alloy powder particles, obtained by the hydrogen pulverization process, from being blown off and scattered. As a result, the alloy powder stored in the containers 10 will not have its overall composition varied so much, thus increasing the yield of the material. This effect is particularly remarkable when the resultant sintered body (or rare earth sintered magnet) has its rare earth element content controlled at about 29.5 mass % to about 32.0 mass % (more particularly about 31.0 mass % or less)

Furthermore, even when the gas is supplied into the inner space 20 at an increased flow rate (or velocity), the process time (i.e., the time it takes to exchange the gases and/or cool the powder) still can be shortened and the throughput can be increased. This is because the flow rate of the gaseous flow produced around the upper opening 10*a* of each container 10, which is high enough to blow off the powder in the prior art, can be reduced according to this preferred embodiment. In addition, there is a much smaller amount of alloy powder particles that have been scattered and left at various locations inside the casing 30. Accordingly, even when the inner space 20 of the casing 30 is exposed to the air and those powder particles are oxidized, the risk of ignition decreases significantly and the hydrogen pulverization process can be carried out much more safely.

In the hydrogen pulverizer 100 according to the preferred embodiment described above, the heater 26 is provided between the gas inlet and outlet ports 32 and 34 that are located under and over the inner space 20, respectively, as shown in FIG. 2. Thus, a gaseous flow that has been produced vertically in the inner space 20 is weakened by the heater 26, while a strong gaseous flow is produced only along the length of the heater 26 (i.e., in the horizontal direction of the inner space 20). Accordingly, to weaken this strong gaseous flow, the windbreak plate 50 is disposed only in front of the containers 10 (i.e., so as to be opposed to the side surfaces 12 of the containers 10).

Figure 7B:
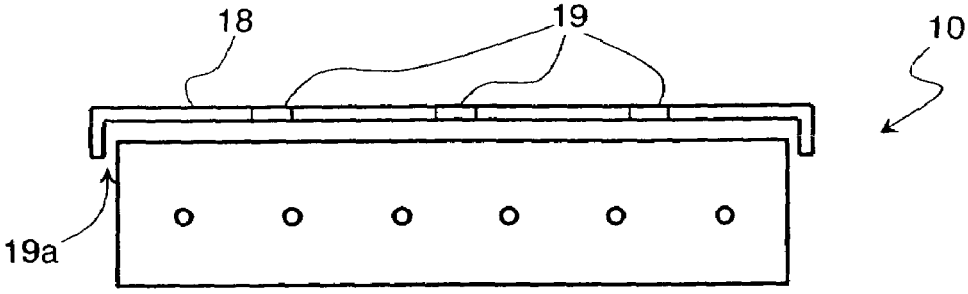
FIG. 7B is a side view of the container 10, over which a cover 18 is disposed additionally, as viewed in the direction indicated by the arrow A in FIG. 7A.

However, when a strong gaseous flow is also produced vertically inside the inner space 20 (e.g., when there is no heater 26), another windbreak plate is preferably further provided over the upper opening 10*a* of the container 10. For example, as shown in FIG. 7B, a cover (i.e., a windbreak plate) 18 may be provided so as to overlap the upper opening 10*a* of the container 10 and prevent the powder particles from being blown off by the strong vertical gaseous flow. To increase the efficiency of heat exchange created by the gaseous flow, the cover 18 preferably includes holes 19. Also, a gap 19*a* is preferably defined between the cover 18 and the top of the side surfaces 12 of the container body 11. Depending on the direction of the gaseous flow that has been produced inside the inner space 20, the windbreak plate 50 may be omitted from the hydrogen pulverizer 100 and the cover 18 may be used as the only windbreak plate.

Method for Producing a Sintered Magnet

Hereinafter, a method for producing a sintered magnet according to a preferred embodiment of the present invention, including a hydrogen pulverization process that is carried out by using the hydrogen pulverizer 100 described above, will be described. In the following specific preferred embodiment, an alloy block (or flake), which has been obtained by a rapid cooling process, is used as a material alloy for the sintered magnet. This is because the hydrogen pulverizer according to the preferred embodiment of the present invention described above is particularly effectively applicable for use to subject such a rapidly solidified alloy to a hydrogen pulverization process.

First, a material alloy for an R—T—(M)—B type magnet having a desired composition is prepared by a known strip casting process and then stored in a predetermined container. This material alloy prepared by the strip casting process preferably has a thickness of about 0.03 mm to about 10 mm. This strip cast alloy preferably includes $R_2T_{14}B$ crystal grains having a minor-axis size of about 0.1 μm to about 100 μm and a major-axis size of about 5 μm to about 500 μm and an R-rich phase, which is dispersed in the grain boundary between the $R_2T_{14}B$ crystal grains. The R-rich phase preferably has a thickness of about 10 μm or less. Before being subjected to the hydrogen pulverization process, the material alloy is preferably coarsely pulverized into flakes having a mean particle size of about 1 mm to about 10 mm. A method of making a material alloy by a strip casting process is disclosed in U.S. Pat. No. 5,383,978, for example, which is hereby incorporated by reference. An alloy flake prepared by such a rapid cooling process is pulverized into finer particles by a hydrogen pulverization process as compared with an alloy ingot prepared by an ingot casting process. Thus, the windbreak plate according to the preferred embodiment of the present invention described above is applicable particularly effectively to such an alloy flake.

Next, the coarsely pulverized material alloy flakes are packed into the containers 10, which are then mounted onto the racks 15. Thereafter, by using a material transporter, for example, the racks 15 on which the containers 10 have been mounted are transported to the front of the hydrogen pulverizer 100 and then loaded into the hydrogen pulverizer 100.

Figure 9:
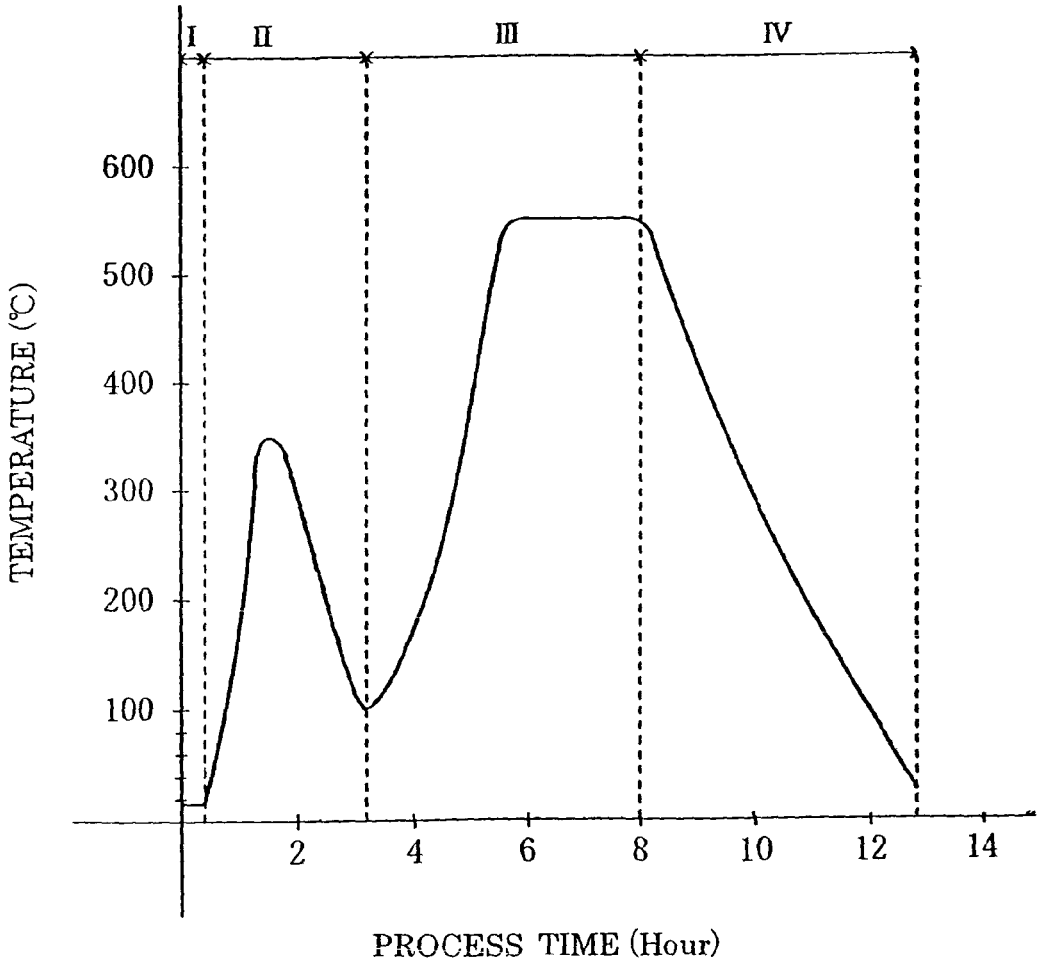
FIG. 9 is a graph showing an exemplary temperature profile for a hydrogen pulverization process.

Subsequently, the lid 36 of the hydrogen pulverizer 100 is closed to start the hydrogen pulverization process. The hydrogen pulverization process may be performed in accordance with the temperature profile shown in FIG. 9, for example. In the specific example of the preferred embodiment shown in FIG. 9, first, a vacuum pumping process step I is performed for approximately 0.5 hour, in which a vacuum of about 1 Pa to about 10 Pa is created in the hydrogen pulverizer 100. Next, a hydrogen occlusion process step II is carried out for approximately 2.5 hours. In the hydrogen occlusion process step II, a hydrogen gas is supplied into the casing 30 to create a hydrogen atmosphere inside the inner space 20. In this process step, the pressure of hydrogen is preferably about 200 Pa to about 400 kPa. Since the alloy flakes occlude hydrogen, the temperature in the inner space 20 once increases to about 300° C.

Subsequently, a dehydrogenation process step III is conducted at a reduced pressure of about 0 Pa to about 3 Pa for approximately 5.0 hours. This dehydrogenation process step III is carried out with the tube 22 sealed up with the front and rear caps 24*a* and 24*b* and with the inner space 20 heated up to about 550° C. by the heater 26. Thereafter, a cooling process step IV is performed on the resultant coarse powder for approximately 5.0 hours with an argon gas being supplied into the casing 30.

In the cooling process step IV, when the atmosphere temperature in the inner space 20 is still relatively high (e.g., over 100° C.), an argon gas at room temperature is supplied into the casing 30, thereby cooling the coarse powder. In this cooling process step, the front and rear caps 24*a* and 24*b* are opened so that the argon gas can be supplied to the inner space 20 inside the tube 22. Thereafter, when the temperature of the coarse powder reaches a relatively low level (e.g., about 100° C. or less), an argon gas that has been cooled to a temperature lower than room temperature (e.g., lower than room temperature by about 10° C.) is preferably supplied into the casing 30 in view of cooling efficiency. The argon gas may be supplied at a flow rate of about 10 $Nm^3$/min. to about 100 $Nm^3$/min.

Once the temperature of the coarse powder has decreased to about 20° C. to about 25° C., an argon gas approximately at room temperature (which is lower than room temperature by no greater than 5° C.) is preferably supplied into the inner space 20 to cool the coarse powder to around room temperature. Then, no condensation will be produced inside the casing 30 when the lid 36 of the hydrogen pulverizer 100 is opened. The condensation inside the casing 30 should be eliminated. The reason is that if there is any water inside the casing 30 due to the condensation, the water should freeze or vaporize in the vacuum pumping process step I, thus taking too much time to complete the vacuum pumping process step I.

When the hydrogen pulverization process is finished, the containers 10 (or racks 15) are preferably unloaded from the hydrogen pulverizer 100 by the method described by the applicant of the present application in Japanese Laid-Open Publication No. 2000-303107, for example.

In the hydrogen pulverizer 100 according to the preferred embodiment of the present invention described above, the windbreak plate 50 is disposed upstream with respect to the gaseous flow, which has been produced inside the inner space 20 where the containers 10 including the rare earth alloy flakes are stored. That is to say, the windbreak plate 50 is disposed in front of the rack 15. Accordingly, the powder particles will not be blown off or scattered by the gaseous flow, which is produced when the gases are introduced into, or exhausted from, the inner space 20 or when an inert gas is supplied into the inner space 20 to cool the coarse powder. For example, when each container 10 is filled with about 20 kg to about 25 kg of alloy flakes, the powder particles will be blown off and scattered to lose about 20 g to about 30 g without the windbreak plate 50. In contrast, by using the hydrogen pulverizer 100 including the windbreak plate 50, the amount of the powder lost can be reduced to only about 2 g to about 3 g. To reduce the amount of the blown off and lost powder to about 2 g to about 3 g without using the windbreak plate 50, the gaseous flow produced inside the inner space 20 should be weakened. Then, the throughput should decrease, which is disadvantageous. Also, the present inventors measured the amounts of carbon in the sintered bodies, which were obtained by sintering the coarse powders that had been prepared with and without the windbreak plate 10, respectively. As a result, when the windbreak plate 50 was not provided, the sintered body had an average carbon concentration of about 470 ppm. On the other hand, when the windbreak plate 50 was provided, the average carbon concentration of the sintered body decreased to about 450 ppm.

Thereafter, the coarse powder, which has been cooled to approximately room temperature, is further milled using a jet mill, for example, thereby making a fine powder of the material. Next, a binder (or lubricant) is mixed with this fine powder and then the mixture is compacted into a desired shape using a compacting machine. In this manner, a green compact is obtained. Then, the green compact is subjected to a series of manufacturing and processing steps including binder removal, sintering, cooling and aging treatment, thereby producing a rare earth alloy sintered magnet.

The present inventors discovered and confirmed via experiments that when the hydrogen pulverizer 100 according to the preferred embodiments of the present invention was used, not only portions that were sintered incompletely due to the unwanted mixture of scattered oxidized powder particles but also the carbon concentration of the sintered body could be reduced.

Various preferred embodiments of the present invention have been described as being applied to a strip cast alloy. However, the present invention is not limited thereto. Alternatively, the present invention is effectively applicable for use to pulverize an alloy that has been rapidly cooled and solidified by a centrifugal casting process as disclosed in Japanese Laid-Open Publication No. 9-31609, for example.

In the preferred embodiments described above, the windbreak plate 50 is a platelike member. However, the windbreak plate has only to decrease the flow rate of the gaseous flow, and may also have the shape of a lattice or net as a combination of multiple bars. Also, in the preferred embodiments described above, the windbreak plate 50 is provided for the racks 15. Alternatively, the windbreak plate 50 may also form an integral part of the side surface of the container 10. Furthermore, in the preferred embodiments described above, the containers 10 are mounted on the racks 15 and then loaded into the inner space 20 of the hydrogen pulverizer 100. Optionally, the containers 10 may also be directly loaded into the inner space 20. In that case, however, those containers 10 are preferably spaced apart from each other both horizontally and vertically using spacers, for example, so as to allow the gas to flow easily between adjacent ones of the containers 10. It should also be noted that although the hydrogen pulverizer according to the preferred embodiments described above uses a box having a bottom and side surfaces as the container 10, a cuplike container, of which the bottom and side surfaces are combined together, may also be used in the present invention.

INDUSTRIAL APPLICABILITY

Various preferred embodiments of the present invention provide an apparatus for subjecting a rare earth alloy to a hydrogenation process by which unwanted oxidation of the rare earth element is minimized sufficiently and productivity is greatly increased, and also provide a method for producing a rare earth sintered magnet with the productivity increased.

The hydrogenation apparatus according to various preferred embodiments of the present invention can be used effectively to pulverize a rare earth alloy block by a hydrogen pulverization technique in a manufacturing process of a rare earth sintered magnet, thereby increasing the yield of the material and the throughput. This apparatus is particularly effectively applicable for use in the hydrogen pulverization process of a rare earth alloy block that has been prepared by a rapid cooling process.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

The invention claimed is:

1. An apparatus for subjecting a rare earth alloy block to a hydrogenation process, the apparatus comprising:

a casing that defines an inner space for receiving a container, the container including an upper opening and arranged to store the rare earth alloy block therein;

a gas inlet port for introducing a hydrogen gas and an inert gas into the inner space of the casing;

a gas outlet port for exhausting the gases from the inner space of the casing;

a member arranged to produce a gaseous flow inside the inner space; and a windbreak plate, which is disposed upstream with respect to the gaseous flow that has been produced inside the inner space and which reduces a flow rate of the gaseous flow that has been produced near the upper opening of the container.

2. The apparatus of claim 1, wherein the container further includes a bottom surface and side surfaces, and wherein the windbreak plate includes:

a shielding portion, which is located at a vertical level substantially corresponding to that of the upper opening of the container; and at least one opening, which is opposed to at least one of the side surfaces of the container.

3. The apparatus of claim 2, wherein the container includes at least one hollow pipe, the hollow pipe connecting together two of the side surfaces of the container and having an inner surface that is substantially continuous with the two side surfaces of the container, the two side surfaces of the container being opposed to the windbreak plate.

4. The apparatus of claim 3, wherein the at least one opening of the windbreak plate is disposed so as to face the at least one hollow pipe.

5. The apparatus of claim 1, further comprising a second windbreak plate, the second windbreak plate including a shielding portion that covers the upper opening of the container.

6. The apparatus of claim 5, wherein the second windbreak plate has at least one opening.

7. An apparatus for subjecting a rare earth alloy block to a hydrogenation process, the apparatus comprising:

a casing that defines an inner space for receiving a container, the container including an upper opening and arranged to store the rare earth alloy block therein, an atmosphere inside the inner space being controllable to a reduced-pressure state;

a gas supply member arranged to supply a gas into the inner space of the container; and a windbreak plate, which reduces a flow rate of a gaseous flow that has been produced near the upper opening of the container.

8. A method for producing a rare earth sintered magnet, the method comprising the steps of:

(a) preparing a container, which includes an upper opening and which stores a rare earth alloy block therein;

(b) pulverizing the rare earth alloy block into a coarse powder by performing a hydrogen pulverization process using the apparatus as recited in claim 1;

(c) making a fine powder from the coarse powder; and (d) compacting the fine powder to obtain a green compact and sintering the green compact.

9. The method of claim 8, wherein the rare earth alloy block is a rare earth alloy flake that has been obtained by subjecting a melt of a rare earth alloy to a quenching process.

* * * * *